US006142757A

United States Patent [19]

Borchert

[11] Patent Number: 6,142,757

[45] Date of Patent: Nov. 7, 2000

[54] INTEGRAL OIL PUMP

[75] Inventor: David T. Borchert, Kasota, Minn.

[73] Assignee: Emerson Electric Co., St. Louis, Mo.

[21] Appl. No.: 09/274,591

[22] Filed: Mar. 23, 1999

[51] Int. Cl.[7] ..... F04C 18/00; F03D 9/00

[52] U.S. Cl. ..... 418/191; 418/206.1; 418/89; 418/181; 418/201.1; 417/420; 290/44; 290/4; 101/216; 416/11; 60/718

[58] Field of Search ..... 418/191, 206.1, 418/89, 181, 201.1; 417/420; 290/44, 4; 101/216; 416/11; 60/718

[56] References Cited

U.S. PATENT DOCUMENTS

| | | | |
|---|---|---|---|
| 1,357,301 | 11/1920 | Reaugh | 418/201.1 |
| 2,382,539 | 8/1945 | Brady, Jr. . | |
| 3,014,623 | 12/1961 | Horn et al. . | |
| 3,495,538 | 2/1970 | Kruckeberg . | |
| 3,514,219 | 5/1970 | Mitchell et al. . | |
| 3,576,379 | 4/1971 | Parise . | |
| 4,127,365 | 11/1978 | Martin et al. . | |
| 4,203,710 | 5/1980 | Farr . | |
| 4,239,977 | 12/1980 | Strutman | 290/44 |
| 4,334,508 | 6/1982 | Sasaki . | |
| 4,459,950 | 7/1984 | Kasting . | |
| 4,488,053 | 12/1984 | Cronin | 290/4 |
| 4,551,073 | 11/1985 | Schwab . | |
| 4,692,094 | 9/1987 | Kulinyak | 416/11 |
| 5,115,738 | 5/1992 | Grutzmacher et al. | 101/216 |
| 5,242,278 | 9/1993 | Vanderslice et al. . | |
| 5,398,508 | 3/1995 | Brown | 60/718 |
| 5,540,569 | 7/1996 | Altham et al. | 417/420 |
| 5,725,362 | 3/1998 | Zepp et al. . | |

FOREIGN PATENT DOCUMENTS

| | | |
|---|---|---|
| 0025974 | 4/1981 | European Pat. Off. . |
| 002591702A1 | 6/1987 | France . |
| 869156 | 7/1949 | Germany . |
| 362003116A | 1/1987 | Japan . |
| 408218942A | 8/1996 | Japan . |

*Primary Examiner*—Thomas Denion
*Assistant Examiner*—Thai-Ba Trieu
*Attorney, Agent, or Firm*—Howrey Simon Arnold & White, LLP

[57] ABSTRACT

An integral oil pump for an apparatus having a plurality of bearings, the oil pump comprising a housing with an opening for a shaft, a cavity within the housing, a ring gear encircling the shaft with clearance between the shaft and an inner surface of the ring gear, a plurality of evenly spaced keyways in the inner surface or the ring gear, a plurality of protrusions extending from the shaft that fit into the keyways to rotate the ring gear when the shaft is rotated, a floating gear meshing with the ring gear, the cavity enclosing the gears with very little clearance between the cavity and the gears, an inlet portion of the cavity adjacent the area where the gears mesh, an outlet portion of the cavity adjacent the area on the other side of where the gears mesh, an inlet port in fluid communication with the inlet portion of the cavity and an oil reservoir, an outlet port in fluid communication with the outlet portion of the cavity and with the bearings to supply pressurized oil to the bearings.

10 Claims, 3 Drawing Sheets

INTEGRAL OIL PUMP

TECHNICAL FIELD

The invention relates to an integral oil pump and more particularly to a lubricating oil pump for a generator.

BACKGROUND ART

Large generators have journal bearings often lubricated by oil rings, which rest on the top of the shaft. As the shaft rotates so does the oil ring to bring oil from a reservoir disposed under the journal bearing to the top of the shaft to lubricate the bearing. There is clearance between the journal bearing and the shaft so that as the shaft rotates a wedge of lubricating oil builds between the shaft and journal bearing floating the shaft on the wedge of oil. When generators are installed on a ship or large boat the pitch and roll upsets the action of the oil ring and may interrupt the flow of oil to the bearings. To prevent this, pressurized oil is supplied to the bearing. Also larger thrust bearings normally require that they be supplied with pressurized oil. To provide a fail safe lubricating oil supply from an oil pump, the oil pump should be driven by the generator.

DISCLOSURE OF THE INVENTION

Among the objects of the invention may be noted the provision of an oil pump with close internal tolerances driven by the rotation of the shaft which moves within a journal bearing.

In general, a integral oil pump for an apparatus having a rotatable shaft supported by a journal bearing when made in accordance with this invention, comprises a housing with an opening for the shaft and a cavity within the housing. A ring gear that encircles, but does not touch the shaft and at least one keyway disposed in an inner surface of the ring gear. A protrusion extends from the shaft and into the keyway to rotate the ring gear with the shaft. A floating gear meshes with the ring gear. The cavity encloses the gears with a minimum amount of clearance between the gears and the cavity. An oil inlet portion of the cavity is disposed on one side of the area where the gears mesh and an oil outlet portion of the cavity is disposed on the other side of the area where the gears mesh. An inlet port is disposed in fluid communication with the oil inlet portion of the cavity and an outlet port is disposed in fluid communication with the oil outlet portion of the cavity. The oil outlet port is also fluid communication with the bearing, whereby the integral oil pump supplies lubricating oil to the bearing when the apparatus is operating and the shaft is free to move within the bearing to its operating position without affecting the clearances in the integral pump.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

BEST MODE FOR CARRYING OUT THE INVENTION

Figure 1:
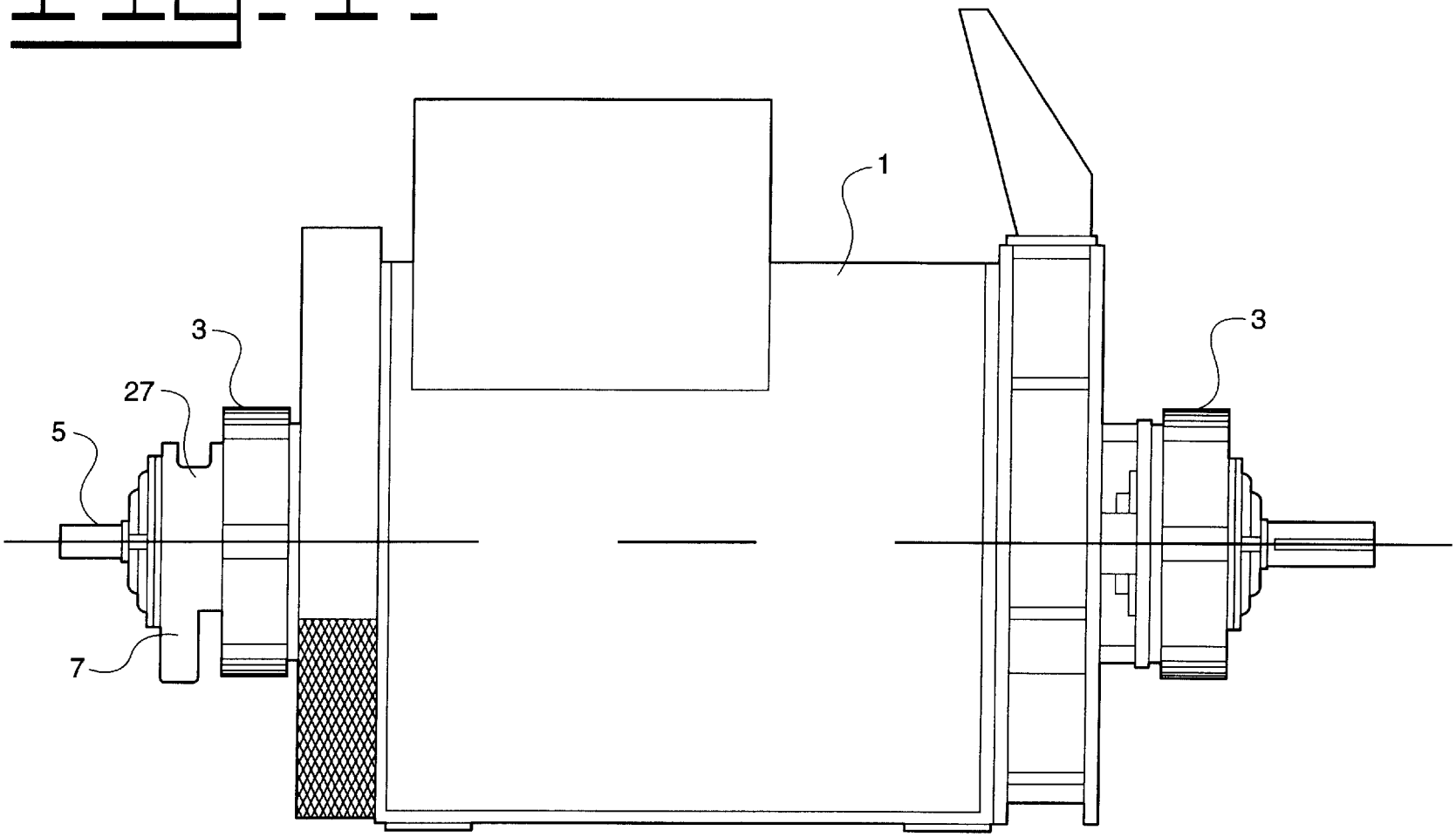
FIG. 1 is an elevational view of a generator with an integral oil pump disposed on one end thereof.

Referring now to the drawings in detail and in particular to FIG. 1, there is shown a an electrical apparatus 1 such as a generator with a journal bearing housing 3 disposed on each end to rotatably support a shaft 5 of a rotor (not shown). An integral oil pump 7 is disposed outboard of a journal bearing housing 3. The shaft 5 extending through the journal bearing housings 3 and through the integral oil pump 7.

Figure 2:
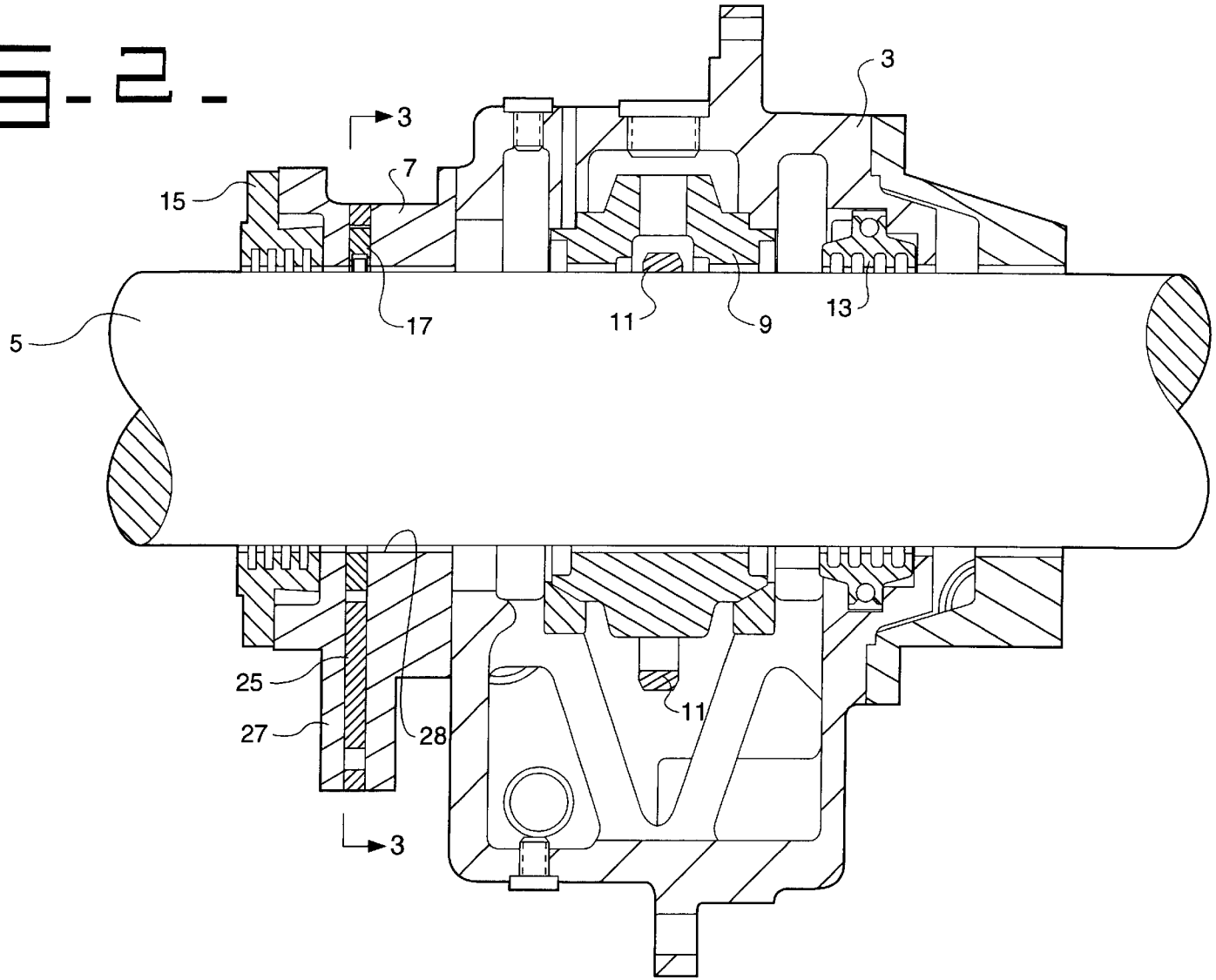
FIG. 2 is a sectional view of a journal bearing assembly incorporating an integral oil pump.

Referring now to FIG. 2 in detail there is shown a journal bearing 9 disposed in the journal bearing housing 3 to rotatably support the shaft 5. An oil ring 11 that rides on the shaft 5 and brings lubricating oil from a lower portion of the housing 3 to the top of the shaft 5. There is clearance between the journal bearing 9 and the shaft 5 so that as the shaft 5 rotates a wedge of oil is formed between the journal bearing 9 and the shaft 5. This causes the shaft to move up and float on this lubricating oil wedge. A labyrinth seal 13 is disposed on the inboard end of the journal bearing housing 3 to prevent the lubricating oil from entering the generator 1. A second labyrinth seal 15 is disposed outboard of the integral oil pump 7 to prevent oil from leaking from the integral oil pump 7.

Figure 3:
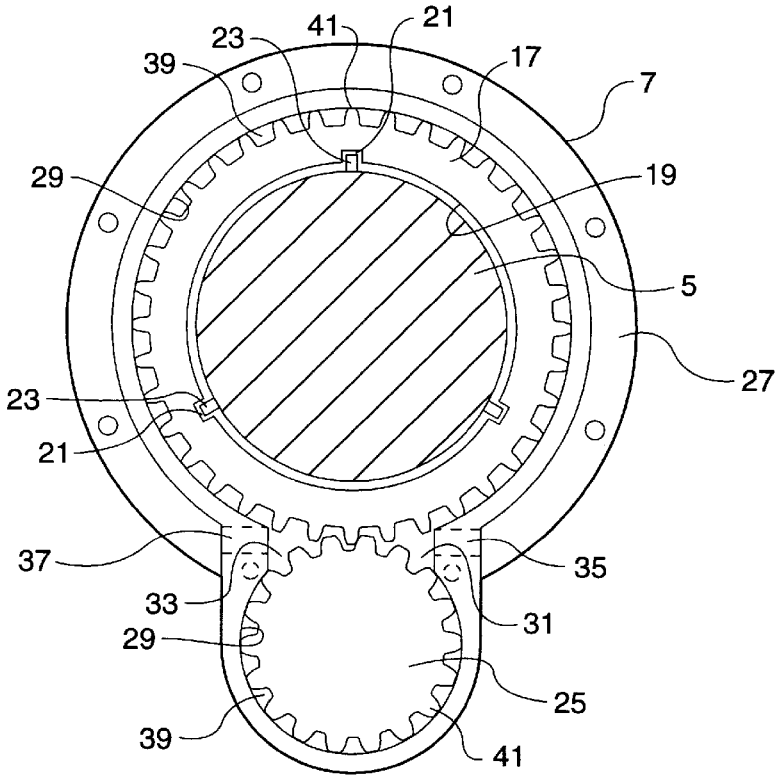
FIG. 3 is a sectional view of the integral oil pump taken on line III—III of FIG. 2.

Referring now to FIG. 3 in detail the integral oil pump 7 comprises a ring gear 17 that encircles the shaft 5 with substantial clearance between an inner surface 19 of the ring gear 17 and the shaft 5. The ring gear 17 has at least one keyway 21 disposed in the inner surface 19. In this embodiment there are a plurality or three keyways 21 equally spaced on the inner surface 19 of the ring gear 17. Protrusions 23 in the form of socket head screws, pins, keys or splines extend from the shaft 5 into the keyways 21 to rotate the ring gear 17 with the shaft 5. This also allows the shaft to reposition itself within the journal bearing to float on the wedge of lubricating oil without repositioning the ring gear 17. This clearance also allows any lubricating oil that leaks from the integral oil pump 7 to seep into the journal bearing housing 3, preventing lubricating oil from leaking from the apparatus 1. A floating gear 25 not attached to anything meshes with the ring gear 17. A pump housing 27 has an opening for the shaft 5 and a cavity 29 in which the ring and floating gears 17 and 25 fit with a minimum amount of clearance between the gears 17 and 25 and the cavity 29. An inlet portion 31 of the cavity 29 is disposed on the inlet side of the area where the gears 17 and 25 mesh. An outlet portion 33 of the cavity 29 is disposed on the outlet side of the area where the gears 17 and 25 mesh. An inlet port 35 is disposed in fluid communication with the inlet portion 31 of the cavity 29. An outlet port 37 is disposed in fluid communication with the outlet portion 33 of the cavity 29. As the ring gear 17 is rotated counter clockwise by the shaft 5, the floating gear 25 rotates clockwise. Spaces 39 disposed between gear teeth 41 carry the lubricating oil from the inlet portion 31 of the cavity 29 to the outlet portion 33 of the cavity 29. The lubricating oil also provides an oil film between the cavity 29 and the gears 17 and 25 allowing them to rotate therein without substantial wear.

Figure 4:
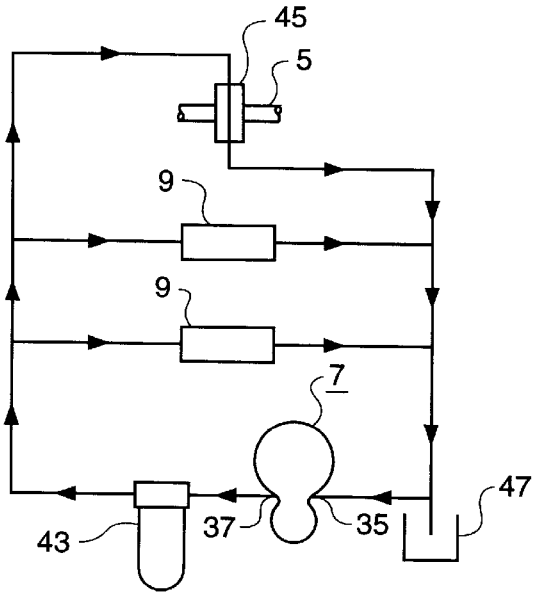
FIG. 4 is a schematic view showing the flow of oil from the integral oil pump to the bearings.

Referring now to FIG. 4 there is shown a schematic drawing showing the integral oil pump 7 that pumps lubricating oil from the outlet port 37 through an oil filter to the journal bearings 9 and to a thrust bearing 45. Lubricating oil from the bearings 9 and 45 is returned to the inlet port 35 of the pump 7 or to a reservoir 47. Thus the oil rings can be removed and pressurized oil can be fed to the journal and thrust bearings 9 and 45. This is particularly advantageous when the generator 1 is installed on a large boat or ship which is subject to rolling and pitching that can cause the oil rings 11 to malfunction. One integral oil pump 7 is shown providing pressurized lubricating oil to all of the bearings 9 and 45 in the apparatus 1. A single integral oil pump 7 could only provide lubricating oil to one bearing or there could be an integral oil pump 7 for each bearing.

A typical application would be an integral oil pump 7 that is about three inches along the shaft 5 and has a capacity generally about seven gallons per minute at about eighty pounds per square inch of pressure. To increase the capacity the gears 17 and 25 could be made thicker.

While the preferred embodiments described herein set forth the best mode to practice this invention presently contemplated by the inventors, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

Industrial Applicability

An integral oil pump made in accordance with this invention advantageously provides a fail safe oil pump that will supply pressurized oil to the bearings any time the apparatus is running. It also allows the shaft to position itself on a wedge of oil in the journal bearings without repositioning the ring gear. It also allows the shaft to pass through the pump so that an engine can be coupled to each side of the generator.

What is claimed is:

1. An integral oil pump for an apparatus having a rotatable shaft supported by a journal bearing, the integral oil pump comprising a housing having an opening for the shaft and a cavity disposed within the housing, a ring gear encircling, but not touching the shaft and at least one keyway disposed in an inner surface of the ring gear, a protrusion extending from the shaft into the keyway to rotate the ring gear with the shaft, a floating gear meshing with the ring gear, the cavity enclosing the ring and floating gears with a minimum amount of clearance between the gears and the cavity, an oil inlet portion of the cavity disposed on one side of the area where the gears mesh and an oil outlet portion of the cavity disposed on the other side of the area where the gears mesh, an inlet port in fluid communication with the oil inlet portion of the cavity and an outlet port in fluid communication with the oil outlet portion of the cavity, the oil outlet port also being in fluid communication with the bearing, whereby the integral oil pump supplies lubricating oil to the bearing when the apparatus is operating and the shaft is free to move within the bearing to its operating position without affecting the clearances in the integral pump.

2. An integral oil pump as set forth in claim 1, wherein the pump is disposed outboard of the journal bearing.

3. The integral oil pump as set forth in claim 2, wherein an oil filter is disposed between the pump and the bearing.

4. The integral oil pump as set forth in claim 3, wherein the shaft also has a thrust bearing cooperatively associated therewith and the pump supplies oil to the thrust bearing.

5. The integral oil pump as set forth in claim 1, wherein the ring gear has a plurality of keyways evenly spaced in the inner surface and the shaft has mating protrusions that extend into the keyways to rotate the ring gear with the shaft.

6. The integral oil pump as set forth in claim 5, wherein the apparatus is an electric generator.

7. An integral oil pump as set forth in claim 6, wherein the pump is disposed outboard of the journal bearing.

8. The integral oil pump as set forth in claim 7, wherein an oil filter is disposed between the pump and the bearing.

9. The integral oil pump as set forth in claim 8, wherein the shaft also has a thrust bearing cooperatively associated therewith and the pump supplies oil to the thrust bearing.

10. The integral oil pump as set forth in claim 9, wherein the ring gear has a plurality of keyways evenly spaced in the inner surface and the shaft has mating protrusions that extend into the keyways to rotate the ring gear with the shaft.

* * * * *